US005183344A

United States Patent [19]

Pawlak et al.

[11] Patent Number: 5,183,344

[45] Date of Patent: Feb. 2, 1993

[54] QUIET IMPACT PRINTER MECHANISM

[75] Inventors: Stephen M. Pawlak, Cortland; Roger J. Rimbey, Spencer; Mark D. Rodee, Groton, all of N.Y.

[73] Assignee: Smith Corona Corporation

[21] Appl. No.: 708,554

[22] Filed: May 31, 1991

[51] Int. Cl.[5] ..... B41J 7/34; B41J 7/30

[52] U.S. Cl. ..... 400/160; 400/157.2; 400/377; 400/432; 101/93.3

[58] Field of Search ..... 400/160, 377, 378, 432, 400/157.2, 144.2, 388, 391.2; 101/93.29, 93.30, 93.31

[56] References Cited

U.S. PATENT DOCUMENTS

| | | | |
|---|---|---|---|
| 1,561,450 | 11/1925 | Going | 400/392 |
| 3,888,339 | 6/1975 | Nowak et al. | 400/161.5 |
| 4,078,485 | 3/1978 | Guthrie | 400/157.2 |
| 4,359,287 | 11/1982 | Asahi | 400/166 |
| 4,668,112 | 5/1987 | Gabor et al. | 400/157.3 |
| 4,678,355 | 7/1987 | Gabor et al. | 400/389 |
| 4,681,469 | 7/1987 | Gabor | 400/157.2 |
| 4,737,043 | 4/1988 | Gabor et al. | 400/157.2 |
| 4,859,096 | 8/1989 | Waibel | 400/59 |
| 4,867,584 | 9/1989 | Savage et al. | 400/157.3 |
| 4,874,265 | 10/1989 | Waibel | 400/357 |
| 5,011,309 | 4/1991 | Babler et al. | 400/184 |

FOREIGN PATENT DOCUMENTS

| | | | |
|---|---|---|---|
| 59265029 | 6/1986 | Japan | 400/157.2 |

*Primary Examiner*—Edgar S. Burr
*Assistant Examiner*—Anthony H. Nguyen

[57] ABSTRACT

An improved quiet impact printer mechanism for use with a typewriter or printer which includes a print hammer having a high effective mass at the print point for impacting a character pad against an ink ribbon, paper and a platen at a relatively low velocity. The pinter mechanism drive means includes a cam driven by a low torque reversible motor for moving a cam follower. The cam follower is coupled to the hammer by means of a pin and moves the hammer towards the platen. The cam may also cause movement of the hammer toward the platen under a predetermined series of controlled velocities.

18 Claims, 3 Drawing Sheets

QUIET IMPACT PRINTER MECHANISM

CROSS-REFERENCE TO RELATED APPLICATIONS

There are no related applications.

STATEMENT AS TO RIGHTS TO INVENTION MADE UNDER FEDERAL SPONSORED RESEARCH AND DEVELOPMENT

The invention disclosed and claimed herein was not made under any federally sponsored research and development program.

BACKGROUND OF THE INVENTION

1. Field of the Invention

The present invention relates generally to impact printing mechanisms used in typewriters and printers and more particularly to a low cost impact printer mechanism which produces a low level of acoustic noise during operation.

2. Description of the Prior Art

Both typewriters and printers utilizing impact printing mechanisms often generate high levels of acoustic noise. There have been various solutions proposed to lower the noise generated by such printing mechanisms. It has, for example, been the practice in the typewriter and printer art to reduce noise by the use of platens having a reduced hardness. This solution has, however, been found to also reduce the print quality. Another practice has been to reduce the required impact velocity by increasing the effective or apparent mass of the hammer or anvil. Other examples of mechanisms embodying this practice are disclosed in U.S. Pat. Nos. 4,668,112, 4,681,469, 4,678,355, 4,737,043, 4,859,096, 4,867,584, and 4,874,265. These mechanisms typically include an additional mass which is remote from and coupled to the print hammer by a rigid connecting drive member. Another example is U.S. Pat. No. 1,561,450 which discloses a weight remote from the type bar that upon activation produces the necessary momentum to straighten a toggle and impart movement to the type element. An example of a mechanism in which the weight is mounted on a print hammer activated by a solenoid is the Model A-3250 electronic typewriter manufactured by Sharp Corporation.

In accordance with the present invention, a weighted print hammer is driven by a cam. The combination of a print drive cam and a continuously rotating motor to accelerate a single head print element for printing is disclosed in U.S. Pat. No. 4,359,287, but unlike the present device, the print hammer disclosed therein is not weighted.

SUMMARY OF THE INVENTION

The purpose of the present invention is to provide a low cost quiet impact printing mechanism for use in a typewriter or printer. The present invention comprises a printer mechanism supported on a pivotal bracket carried on a horizontally moveable carrier. The printer mechanism includes a weighted print hammer or anvil which is pivotally supported for movement toward and away from a platen. The pivotal hammer arm also includes a cam follower roller which is spring biased to engage a rotatable cam driven by a reversible electric motor. The cam surface against which the cam follower roller bears is formed so that when it rotates in one direction, the vertically oriented weighted hammer is driven to the platen. The cam surface may have, for example, two distinct surface areas to impart selected acceleration characteristics to the hammer. The anvil or hammer contacts the rear of a daisy wheel character petal and drives it toward the platen and into contact with the interposed ink ribbon and paper. After printing (which occurs when the foregoing elements impact the platen) the motor reverses direction and the hammer returns to its rest position by rebound and under the urging of a spring bias. Enhanced print quality and low impact noise are obtained because the platen is relatively hard and a heavily weighted hammer impacts the platen at a reduced velocity. The motor may be a reversible d.c. variable speed motor.

Accordingly, it is an object of this invention to provide a low cost, reliable, quiet impact printer mechanism for use in a typewriter or printer.

Another object of this invention is to provide a low cost, simple, and quiet printer mechanism which is readily assembled and consists of a reduced number of components.

Other objects and many of the attendant advantages of this invention will be readily appreciated as the same become better understood by references to the following detailed description when considered in connection with the accompanying drawings in which like reference numerals designate like parts throughout the figures thereof.

DETAILED DESCRIPTION OF THE PREFERRED EMBODIMENT

Figure 1:
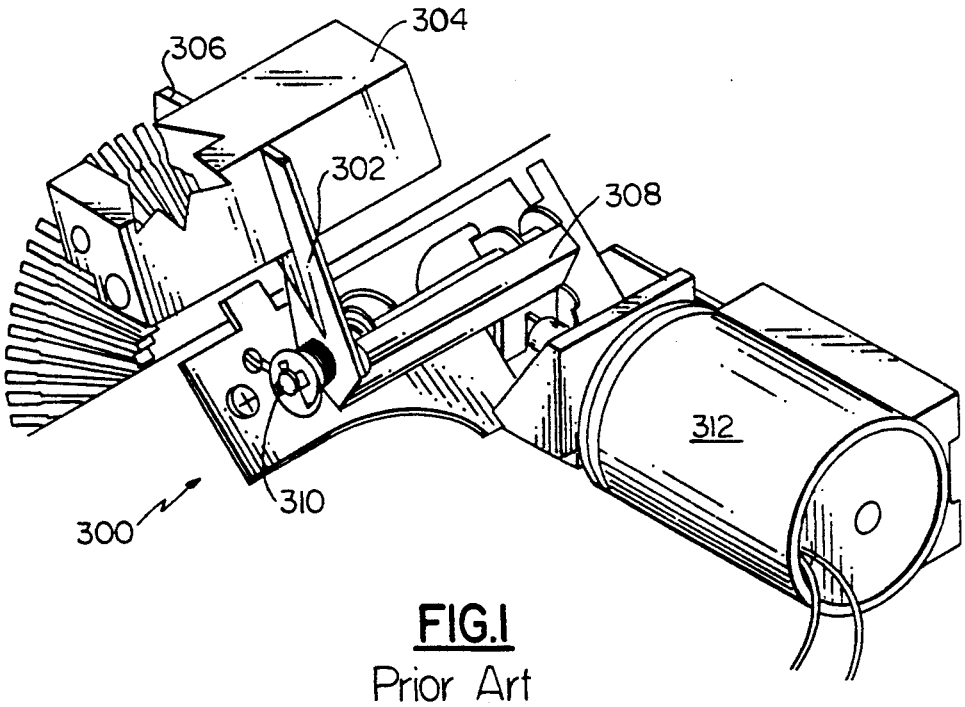
FIG.1 Prior Art
FIG. 1 is a front left side perspective view of a prior art printer mechanism.
Figure 2:
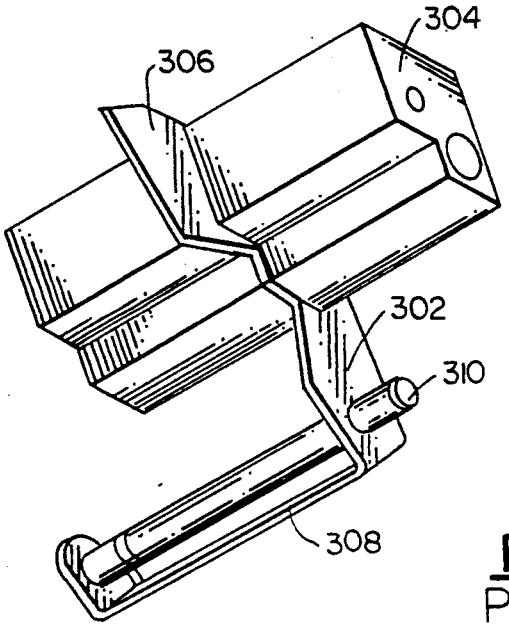
FIG.2 Prior Art
FIG. 2 is a rear perspective view of the weighted print hammer of the prior art printer mechanism of FIG. 1.

For purposes of providing further background to the present invention, there is shown in FIGS. 1 and 2 an illustration of a prior art printing mechanism embodied in an electronic portable typewriter Model A-3250 manufactured by Sharp Corporation of Japan. The printing mechanism 300 includes a print hammer 302 comprising a rigidly mounted mass 304 proximate an anvil 306. The print hammer 302 has an extended arm 308 pivotally mounted on a shaft 310.

A solenoid 312 is connected to the arm 308 for actuating the print hammer 302. This printing mechanism 300 includes a solenoid 312 to drive the print hammer 302 at a relatively high velocity. The impact velocity of the print hammer 302 has been determined to be in the approximate range of 60 inches per second, which is relatively high compared to the velocity of a preferred embodiment of the present invention, which has a range of approximately 10 to 25 inches per second. In addition, the effective mass of the print hammer 302 at the print point 304 has been determined to be approximately 10 grams, which is relatively low compared to the effective mass, of approximately 35 to 55 grams, of a preferred embodiment of the present invention. The effective mass at the print point is defined to be the mass moment of inertia of the print hammer (i.e. the measure of resistance to rotational acceleration of the print hammer) measured about the print hammer pivot divided by the square of the distance from the center of the print hammer pivot to the print point of the print hammer. The print point is the point on the print hammer that contacts the print element behind the center of an average sized character. The high impact velocity of the print hammer 302 causes high level of acoustic noise during impact printing.

Figure 3:
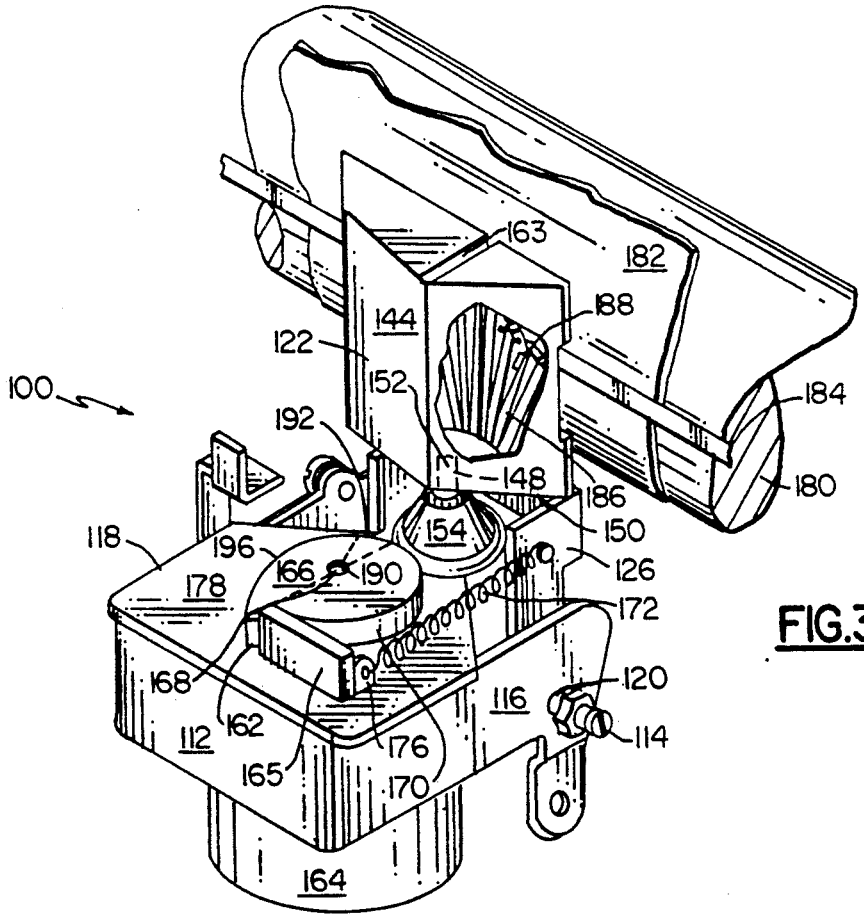
FIG. 3 is a front right side perspective view of the printer mechanism constructed in accordance with the present invention.
Figure 5:
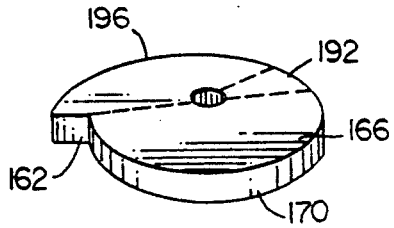
FIG. 5 is a perspective view of the cam which forms a part of the printer mechanism.
Figure 4:
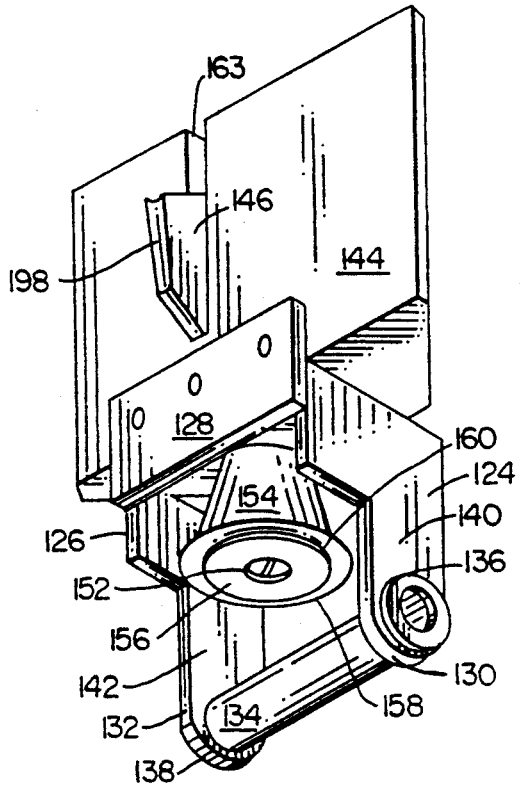
FIG. 4 is a rear perspective view of the weighted print hammer.

In the illustrated embodiment of FIGS. 3 and 4 the low noise impact printer 100 includes a bracket 112 which is pivotally supported on a horizontally moveable carrier (not shown) by screw pins 114 (one shown). A typical such carrier is disclosed in U.S. Pat. No. 4,668,112. The pins 114 extend through openings 120 in opposite walls 116 and 118 of bracket 112 and corresponding openings in the carrier.

A print hammer 122 is coupled to spaced arms 124 and 126 by plate 128. The lower ends 130 and 132 of arms 124 and 126 are integral to tubular shaft 134. The shaft 134 is supported in openings 136 and 138 formed in opposed extensions 140 and 142 of bracket walls 124 and 126. Screw pins 114 which extend through openings 120 of bracket 112 also extend through shaft 134 for joining bracket 112 with shaft 134. In this manner, arms 124, 126 and print hammer 122 coupled therewith are pivotable about shaft 134. Alternatively, the print hammer 122, arms 124 and 126, plate 128, anvil 146 and shaft 134 could be formed as one casted part.

The arms 124 and 126 carry a heavy mass 144 which in turn supports the rigidly mounted anvil 146. The mass 144 can be of any suitable dense alloy such as brass. The mass 144 is formed with a plate 145 (FIG. 4) having a surface projecting in a plane parallel to a platen 180. The mass 144 is also formed with a varying depth 147 (FIG. 3) behind the plate 145 having a maximum dimension substantially behind the anvil 146. The mass 144 is provided with a lower vertically centered hole 148 extending from the bottom surface 150. Confined within the hole 148 is a pin 152 whose lower end carries a cone shaped rotatable cam follower roller 154. The roller 154 can be fabricated from any lightweight, low friction plastic material such as Nylon. To provide a low noise camming action, the base portion 156 carries a rubber "O" ring 158 seated in a peripheral groove 160 of base portion 156. This ring 158 constitutes a cam follower surface and also acts as a shock absorber. The roller 154 may be supported on the pin 152 by an "E" ring (not shown) carried in a groove formed in the pin 152. The mass 144 is formed with an upper notch 163 vertically aligned with the anvil 146 in order to permit the typist to observe the printed character on the line being printed.

The bracket 112 also supports a reversible D.C. electric motor 164 between the opposed walls 116 and 118. This motor 164 is provided with a pair of electrical contacts (not shown) so that when voltage of one polarity is applied, the motor shaft will rotate in one direction and when the polarity is reversed the motor shaft 168 will rotate in the opposite direction.

A cam 166 is mounted for rotation on the forward end of motor shaft 168 with its cam surface 170 in contact with the cam follower surface 158. The cam 166 includes an abutment 162 formed on its surface 170 which serves as a stop. Cam follower roller 154 is urged against the cam surface 170 by biasing spring 172 mounted between support arm 126 and stud bracket 176 formed on the upper surface 178 of bracket 112.

The motor shaft 168 extends into a central bore 190 of cam 166 whereby cam 166 is rotated by rotation of motor shaft 168. The cam operating surface 170 consists of three distinct, smoothly connected surfaces; a first cam surface area 192, a second cam surface area 194, and a third cam surface area 196.

The printer or typewriter includes the platen 180. Supported between the platen 180 and print hammer 122 is an image print medium such as a paper sheet 182, an ink ribbon 184 and daisy print wheel 186. The daisy print wheel 186 is controlled for selected rotation to present a selected character pad 188, carried at the free end of a daisy petal 189, at the print point PP.

Figure 6:
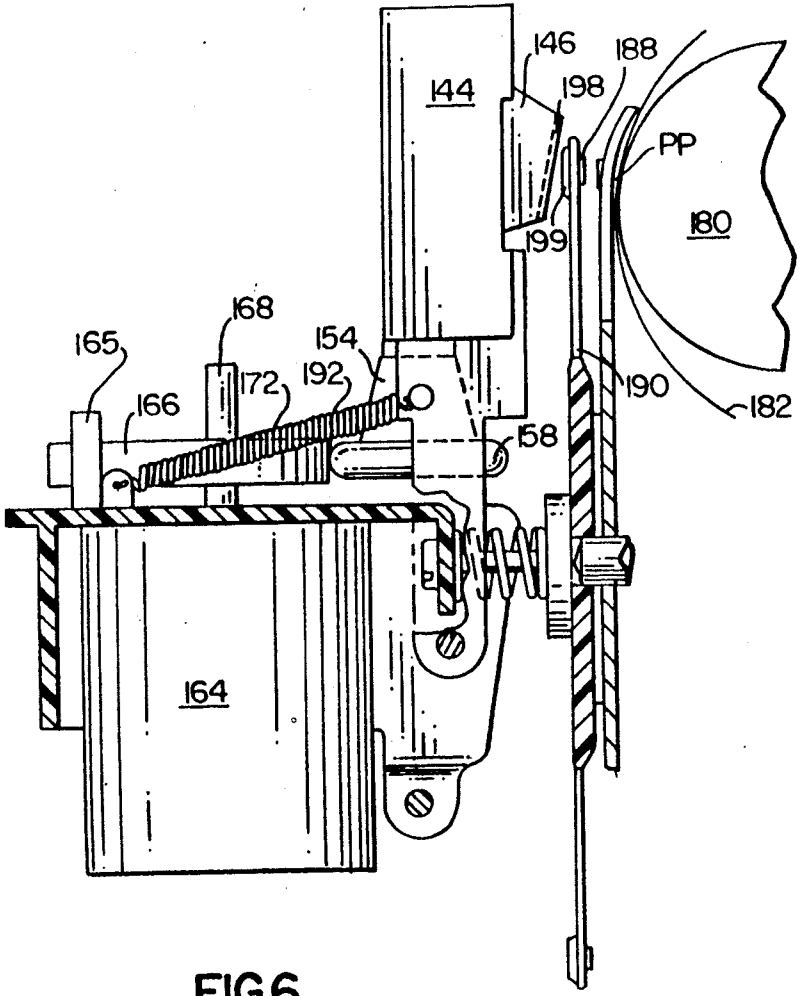
FIG. 6 is a right side section elevational view taken approximately along the vertical center line of the printer mechanism of FIG. 3 with the print hammer in the rest position.

When a key on the keyboard is depressed, the daisy print wheel 186 is rotated so as to locate the character pad, designated by the depressed key, in position for printing. At approximately the same time the daisy print wheel 186 is rotated, a motor 164 is energized for rotation of the cam 166 in a clockwise direction. As the cam 166 begins its rotation, the cam follower roller 154 contacts first cam surface area 192 which is formed so as to remain at a constant distance from the motor shaft 168. As a result, the initial rotation of the cam 166 does not cause cam follower roller 154 to move toward the platen 180 and the print anvil 146 remains in its upright rest position during this portion of cam rotation. FIG. 6 shows the hammer 122 at its rest position with cam follower roller 154 in contact with the first cam surface area 192.

As the cam 166 continues to rotate in a clockwise direction, the roller 154 and, in particular pin 152, on which the roller is mounted, is caused to move toward the platen 180 by the engagement of the second cam surface area 194 with cam follower roller 154. Movement of pin 152, which is coupled to mass 144, causes the print hammer 122 to move toward the platen 180. The distance from the second cam surface area 194 to the shaft 168 generally increases as the cam 166 continues to rotate in a clockwise direction.

With reference to FIG. 4 there is shown a recessed groove 198 on the operating face of anvil 146 for mating with a corresponding protrusion, as is well known, on the rear surface 199 of character pad 188. In this manner, when the anvil 146 contacts and drives the character pad 188 toward the paper 182, ribbon 184, and the platen 180 for printing, there is positive engagement between the anvil 146 and character pad 188.

Figure 7:
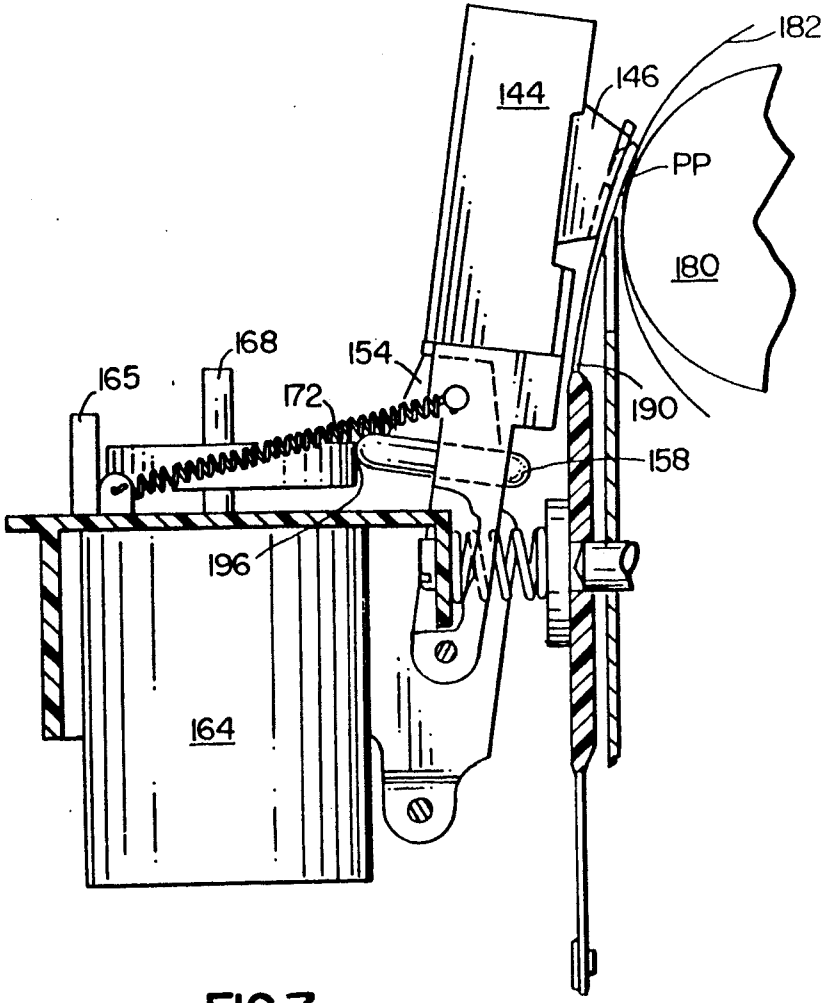
FIG. 7 is a view similar to that of FIG. 6 except with the print hammer at the print point during impact.

FIG. 7 illustrates the relative orientation of the various components at the instant that print occurs, i.e. at the impact of the anvil 146 and character pad 188 against the paper 182, ribbon 184, and in turn against the platen 180. After printing, the motor 164 is energized to rotate in the opposite or counter clockwise direction by reversal of the voltage polarity at the motor terminals. The cam 166 (also see FIG. 3) reverses rotation and rotates until its abutment 162 engages stop member 165 thereby terminating further movement. Stop member 165 is affixed to surface 178 and may be of an elastomeric material. Return spring 172 causes the hammer assembly 122 to return to its rest or upright position.

Thus there are disclosed herein a low cost printer mechanism which exhibits improved print quality and low audio noise. One example of such a mechanism uses a relatively hard platen surface, as for example, a durometer hardness of between 95 and 98 (Shore A Scale) in conjunction with an effective hammer mass weight at the print point of approximately 35 grams to 55 grams. An impact velocity range at the print point of approximately 10 inches/second to 25 inches/second has been found suitable when used with the above-noted hardness and effective hammer mass parameters.

Furthermore, to enhance the uniform intensity of various sized characters, different impact energy levels may be imparted to the print hammer depending on the character being printed. Thus, for example, a lower impact may be imparted to the character "." than to the character "M". Such differentiation may be accomplished by the application of pulsewidth modulation or voltage/current variation to the motor for impact energy level control. In order to maintain low cost, an open loop system of modulation and/or voltage/current is employed.

The operation of the printer mechanism has low forces between the print hammer and the cam during acceleration of the print hammer and at impact of the print hammer. The forces during print hammer acceleration are low because the print hammer receives its kinetic energy gradually due to the urging of the rise portion of the cam. The forces at impact are low because the vast majority of the kinetic energy needed for printing is in the print hammer itself at impact, rather than being in the drive system and being reflected through the drive system, through the print hammer and finally to the print point at impact. The low force mechanism allows the printer mechanism to have a low manufacturing cost.

The low forces also obviate the need for a substantial drive mechanism rigidity, such as a known reaction bar structure, and results in a highly desirable low force on the motor bearing.

The printer mechanism has an open loop motor control. The motor is driven by a fixed predetermined electrical control means. There is no need for feed back to the electronics, such as from an optical encoder, to provide precise motor control.

Obviously, many modifications and variations of the present invention are possible in the light of the above teachings. It is therefore to be understood that, within the scope of the appended claims, the invention may be practiced otherwise than specifically described.

Having thus described the invention, what is claimed is novel and desired to secure by Letters Patent is:

1. An impact printer mechanism for driving a selected character pad of a print element to print a character on a sheet medium supported by a platen, the mechanism comprising:

a print hammer including a mass weight which supports a mounted anvil thereon, said mass weight includes a plate having a surface projecting a plurality of letter spaces in a plane parallel to said platen and includes having a maximum dimension in a direction perpendicular to said platen substantially behind said anvil; and a drive means comprising a rotary cam operatively connected to said print hammer for actuating said print hammer to cause printing, said drive means including cam controlled means for imparting impact velocity to said print hammer.

2. The printer mechanism according to claim 1 wherein said drive means includes a cam supported for rotary movement for driving said print hammer to cause printing.

3. The print mechanism according to claim 1 wherein said anvil for driving the character pad to cause printing is located proximate said mass weight.

4. The printer mechanism according to claim 1 wherein said mass weight is rigidly mounted on said print hammer.

5. The printer mechanism according to claim 3 wherein said anvil is rigidly mounted on said print hammer proximate said mass weight.

6. The printer mechanism according to claim 2 further including cam rotary means for colectively rotating said cam.

7. The printer mechanism according to claim 6 wherein said cam rotary means is an electric motor.

8. The printer mechanism according to claim 7 wherein said electric motor is a reversible d.c. motor.

9. The printer mechanism according to claim 7 wherein said electric motor is a variable speed d.c. motor.

10. The printer mechanism according to claim 7 wherein said electric motor is vertically oriented.

11. The print mechanism according to claim 2 wherein said print hammer includes a follower roller for engaging a cam surface on said cam.

12. The printer mechanism according to claim 11 further including biasing means for urging said cam follower roller against said cam surface.

13. The printer mechanism according to claim 12 wherein said biasing means is a spring.

14. The printer mechanism according to claim 2 wherein said cam surface defines a first cam surface area to allow said print hammer to remain stationary during an initial cam rotation.

15. The printer mechanism according to claim 14 wherein said cam surface defines a second cam surface area to impart sufficient kinetic energy to the print hammer during additional cam rotation to provide low noise printing.

16. The printer mechanism according to claim 1 wherein said mass weight has an effective mass at the print point in the range of 35 to 55 grams.

17. The printer mechanism according to claim 1 wherein said drive means imparts a velocity to said print hammer at the print point in the range of 10 to 25 inches per second.

18. The printer mechanism according to claim 8 wherein said d.c. motor is rotated in one direction for driving the print hammer from an initial position to a printing position and said d.c. motor is rotated in an opposite direction to allow said print hammer to return to said initial position.

* * * * *